US006453977B2

(12) United States Patent
Onuki et al.

(10) Patent No.: US 6,453,977 B2
(45) **Date of Patent: *Sep. 24, 2002**

(54) METAL MOLD FOR MANUFACTURING AMORPHOUS ALLOY AND MOLDED PRODUCT OF AMORPHOUS ALLOY

(75) Inventors: Masahide Onuki, Miki (JP); Akihisa Inoue, 11-806 Kawauchijyutaku, Kawauchimotohasekura 35, Aoba-ku, Sendai-shi, Miyagi (JP); Hisashi Kakiuchi, Akashi (JP)

(73) Assignees: Sumitomo Rubber Industries, Ltd., Kobe (JP); Akihisa Inoue, Sendai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/878,332

(22) Filed: Jun. 12, 2001

Related U.S. Application Data

(63) Continuation of application No. 09/207,273, filed on Dec. 8, 1998, now Pat. No. 6,267,171.

(30) Foreign Application Priority Data

Dec. 10, 1997 (JP) ..... 9-362077
Oct. 23, 1998 (JP) ..... 10-302320

(51) Int. Cl.[7] ..... B22D 18/00; B22D 23/06; B28B 7/38

(52) U.S. Cl. ..... 164/80; 164/120; 164/136; 164/138

(58) Field of Search ..... 164/495, 508, 164/136, 138, 80, 113, 284, 319, 120; 249/135

(56) References Cited

U.S. PATENT DOCUMENTS

| | | | | |
|---|---|---|---|---|
| 4,264,052 A | | 4/1981 | Radtke et al. | |
| 4,548,253 A | | 10/1985 | Funatani et al. | |
| 4,967,826 A | | 11/1990 | Kopp et al. | |
| 5,318,091 A | | 6/1994 | Pavoni et al. | |
| 5,505,246 A | | 4/1996 | Colvin et al. | |
| 5,711,363 A | | 1/1998 | Scruggs et al. | |
| 5,799,717 A | * | 9/1998 | Aoshima et al. | 164/138 |

FOREIGN PATENT DOCUMENTS

| | | | |
|---|---|---|---|
| JP | 57-11749 | 1/1982 | |
| JP | 60-118354 | 6/1985 | |
| JP | 3-275268 | 12/1991 | |
| JP | 3275268 | * 12/1991 | 164/120 |

* cited by examiner

*Primary Examiner*—Kuang Y. Lin
(74) *Attorney, Agent, or Firm*—Armstrong, Westerman & Hattori, LLP

(57) ABSTRACT

A metal mold for manufacturing amorphous alloy. A metal mold is composed of a lower mold having a portion for fusing metal material and a cavity portion, and an upper mold working with the lower mold which presses molten metal in the portion for fusing metal material and pours the molten metal into the cavity portion to mold. And, surface roughness of a part of or all of an inner surface of the metal mold is arranged to be more than 12S in JIS indication.

2 Claims, 14 Drawing Sheets

F
ARC POWER UNIT
Ar
COOLING WATER SUPPLIER
5
M
9
10
M
Ar
4
M
DP
RP
17
1
2
3
6
7
M
8

METAL MOLD FOR MANUFACTURING AMORPHOUS ALLOY AND MOLDED PRODUCT OF AMORPHOUS ALLOY

This application is a continuation of prior application Ser. No. 09/207,273 filed Dec. 8, 1998, now U.S. Pat. No. 6,267,171.

BACKGROUND OF THE INVENTION

1. Field of the Invention

This invention relates to a metal mold for manufacturing amorphous alloy and a molded product of amorphous alloy.

2. Description of the Related Art

Recently, amorphous alloys having very low critical cooling rates of 1 to 100K/s have been developed. These are, for example, amorphous alloys of Zr—Al—Co—Ni—Cu system, Zr—Ti—Al—Ni—Cu system, Zr—Ti—Nb—Al—Ni—Cu system, Zr—Ti—Hf—Al—Co—Ni—Cu system, Zr—Al—Ni—Cu system, etc. And, accompanying these alloys, large (bulk) molded products of amorphous alloy are being produced with various methods. These methods are, for example, forging method in which molten metal is pressed and formed into a predetermined configuration, rolling method in which molten metal is rolled, and casting method in which molten metal is casted into a predetermined configuration. Conventionally, in a metal mold for manufacturing large molded product of amorphous alloy with these methods, it is thought that crystalline core tends to generate at contact points of the molten metal and the metal mold when the molten metal solidifies without high smoothness of the metal mold. Therefore, an inner face of the metal mold, which contacts the molten metal, is polished to be extremely smooth.

However, even an amorphous alloy having very low critical cooling rate, to obtain a large molded product, needs high cooling rate as a whole. On the other hand, to obtain a thin and large plate-shaped molded product, the molten metal has to retain liquidity until completely filled in a cavity portion of the metal mold. Therefore, it is necessary to deliberately set heat conductivity of the metal mold, and control cooling state of the metal mold. However, it is extremely difficult for a necessary condition that the molten metal must be cooled at over the critical cooling rate, and obtaining a molded product of amorphous alloy having large area is very difficult.

Further, in cooling simultaneously with molding, cold shuts are generated by contact of cooled surfaces, and in case that newly poured molten metal of high temperature contacts a cooled amorphous area, the cooled amorphous area is heated and crystallized, the molded product does not totally consist of amorphous phase, and has very bad characteristics. Therefore, it is necessary to control flow of the molten metal to prevent the cooled surfaces from contact. However, there is no time to regulate (control) the flow of the molten metal, because cooling immediately starts when the molten metal flows into the cooled metal mold.

It is therefore an object of the present invention to provide a metal mold for manufacturing amorphous alloy with which a thin and large plate-shaped molded product is obtained, and a molded product of amorphous alloy having excellent strength characteristics.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
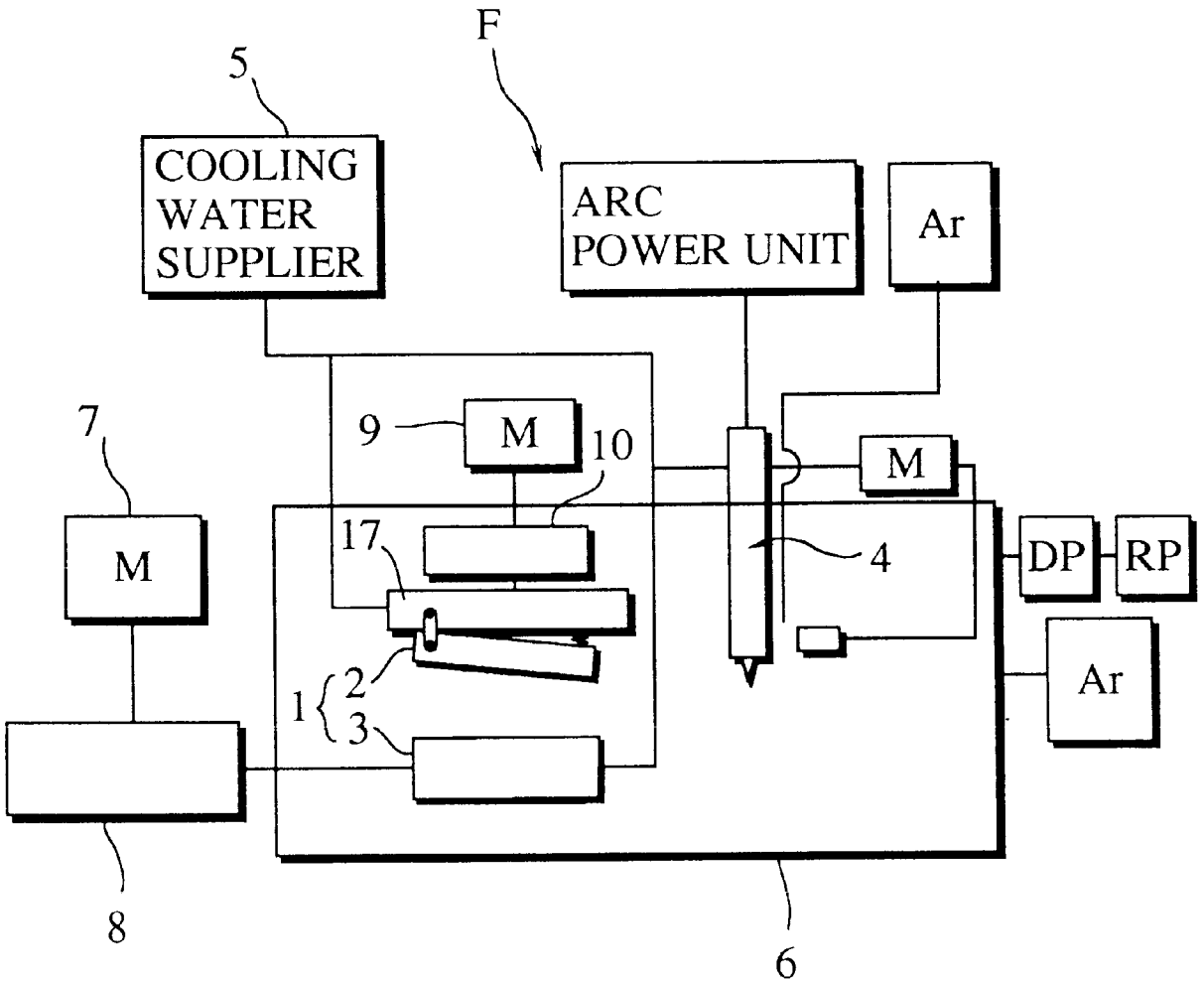
FIG. 1 is a schematic explanatory view of construction showing a manufacturing apparatus which makes amorphous alloy.
Figure 2:
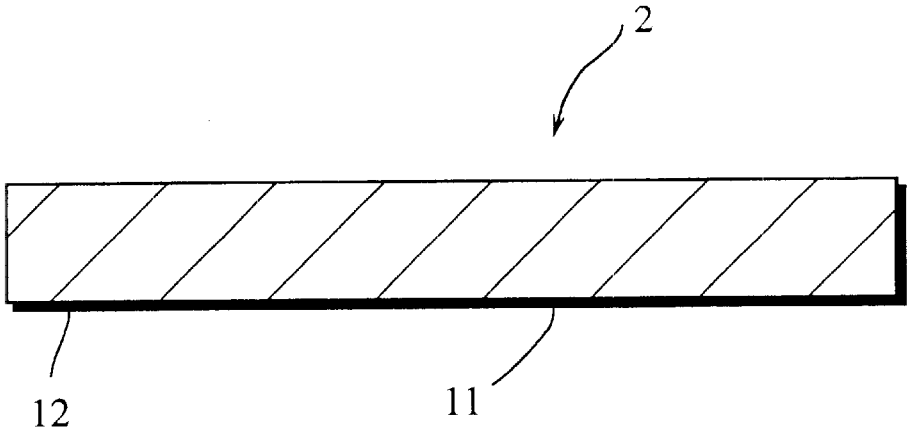
FIG. 2 is a cross-sectional front view of a principal portion showing first embodiment of a metal mold of the present invention.

FIG. 1 shows a manufacturing apparatus F provided with a metal mold 1 for manufacturing amorphous alloy of the present invention. The manufacturing apparatus F is briefly described here. This manufacturing apparatus F is provided with the above mentioned metal mold 1 consists of an upper mold 2 and a lower mold 3 (described later in detail), an arc electrode (a tungsten electrode)4 as a high energy heat source for fusing a metal material placed on the lower mold 3 and an arc power source, a cooling water supplier 5 circulating and supplying cool water to the upper mold 2 and lower mold 3 of the metal mold 1 and the arc electrode 4, a vacuum chamber 6 containing the metal mold 1 and the arc electrode 4, a lower mold moving mechanism 8 driven by a motor 7 and moving the lower mold 3 in horizontal direction, and an upper mold moving mechanism 10 driven by a motor 9 and moving the upper mold 2 in vertical direction.

FIG. 2 through FIG. 5 show an embodiment (first embodiment) of the metal mold relating to the present invention. This metal mold has a configuration without engagement portions. Concretely, FIG. 2 and FIG. 3 respectively show a cross-sectional front view and a bottom view of the upper mold 2, which is formed in a rectangular flat plate with a material having heat conductivity equal to or over $1\times10^2$ kcal/m·h·°C such as copper, copper alloy, silver, etc., and a peripheral edge of a lower face 11 is a parting face 12.

Figure 4:
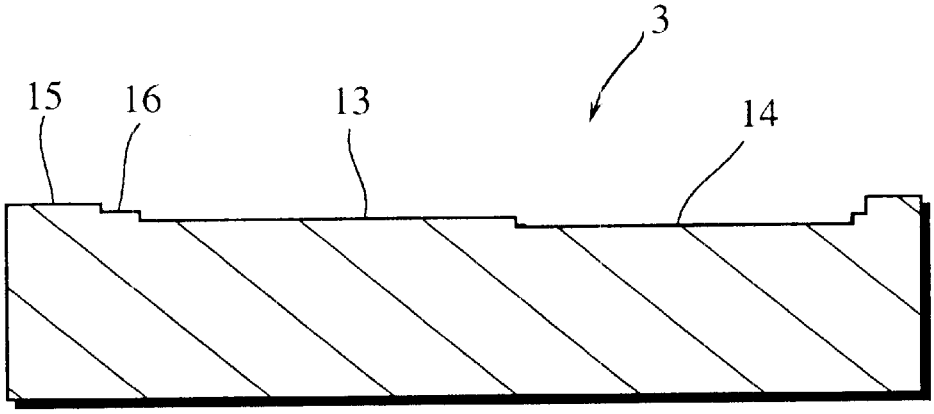
FIG. 4 is a cross-sectional front view.
Figure 5:
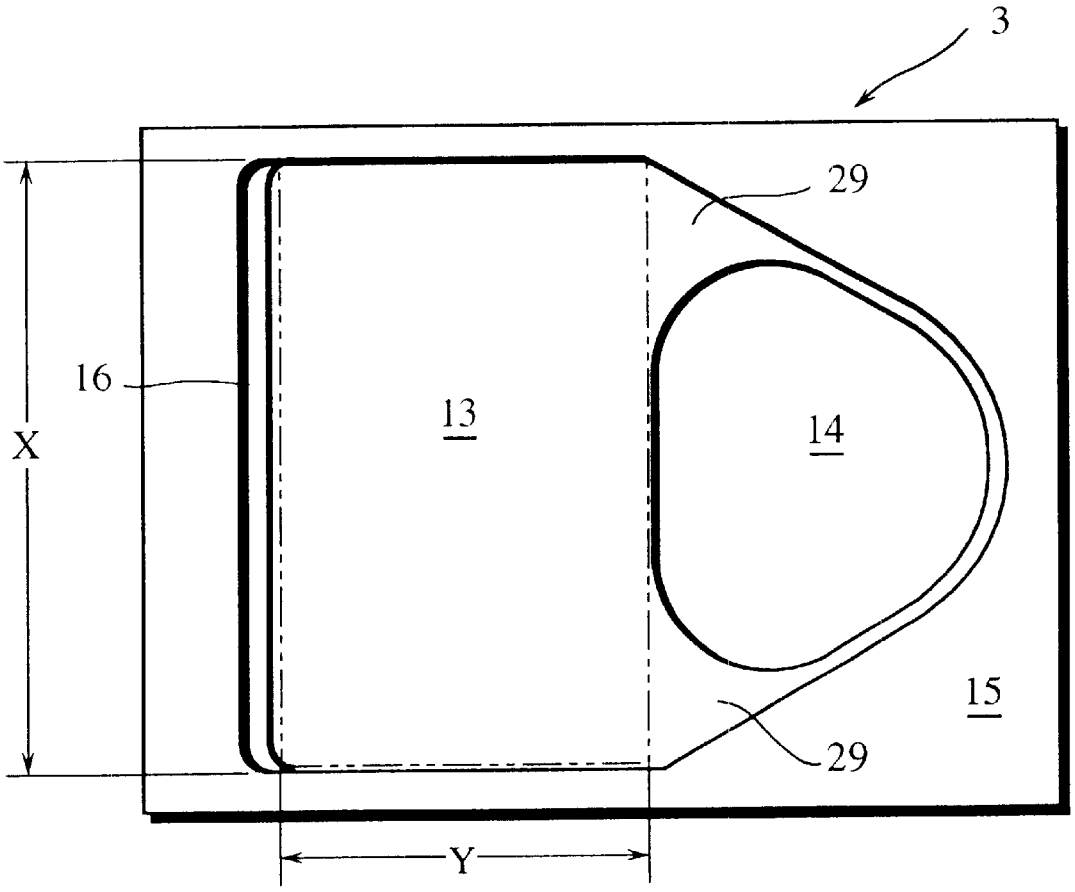
FIG. 5 is a plane view of a principal portion.

FIG. 4 and FIG. 5 respectively show a cross-sectional front view and a bottom view of the lower mold 3, which is composed of a material having heat conductivity equal to or over $1\times10^2$ kcal/m·h·°C such as copper, copper alloy, silver, etc., has a portion 14 for fusing metal material (a shallow concave portion of triangular shape) formed on one end side of its upper face and a cavity portion 13 (an area surrounded by an imaginary line) formed on another end side of the upper face of the lower mold 3, and a peripheral edge of the upper face is a parting face 15 corresponding to the parting face 12 of the upper mold 2. And, an adjacent part of the portion 14 continuously forms a plane with the cavity portion 13.

And, a staged aperture forming portion 16 is formed along the parting face 15 on the other end side of the cavity portion 13, an aperture is formed between the upper mold 2 and the lower mold 3 by this aperture forming portion 16 when the metal mold is closed, and excessive molten metal is absorbed by the aperture. And, configuration of the portion 14 for fusing metal material extends to the cavity portion 13 as molten metal easily flows into the cavity portion 13.

Figure 3:
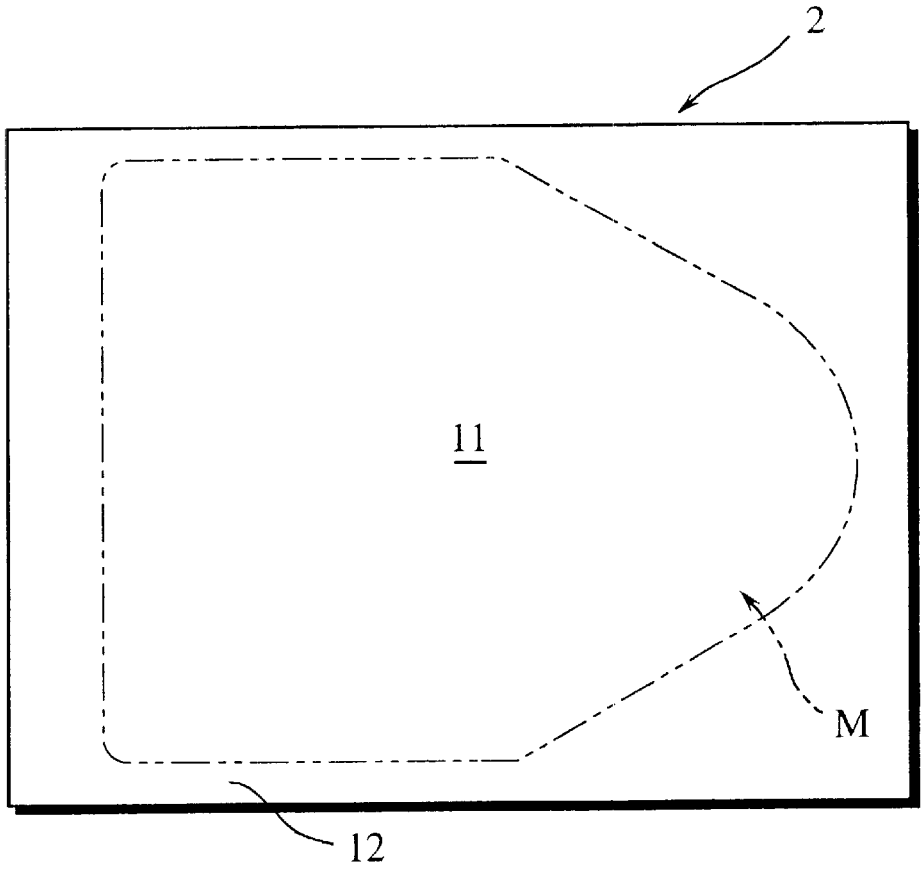
FIG. 3 is a bottom view of a principal portion.
Figure 6A:
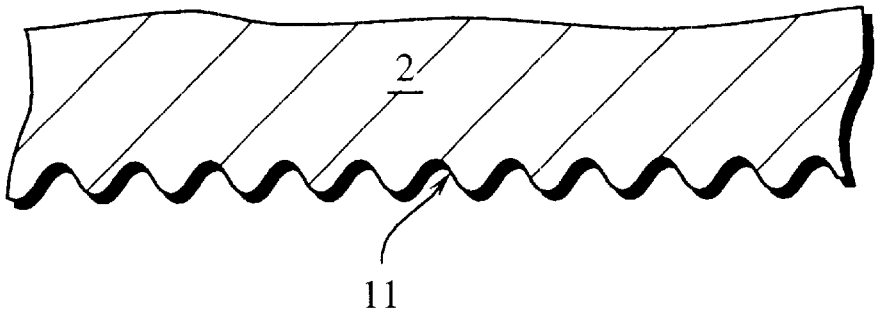
FIG. 6A is an enlarged cross-sectional view showing a surface state of an inner face of the metal mold.
Figure 6B:
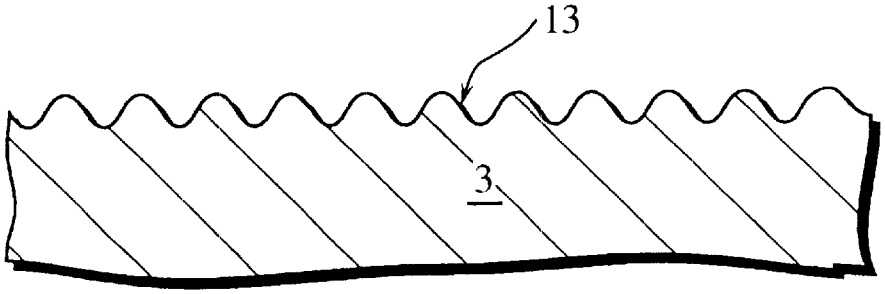
FIG. 6B is an enlarged cross-sectional view showing a surface state of an inner face of the metal mold.

Further, in the metal mold of the present invention, surface roughness of a part of or the whole of an inner face of the metal mold which contacts the molten metal is regulated to be a predetermined roughness. Concretely, as shown in FIG. 3 and FIG. 6A, surface roughness of a part of the lower face 11 of the upper mold 2, namely, a part shown with an imaginary line corresponding to concave portions of the lower mold 3 (the portion 14 for fusing metal material and the cavity portion 13), or of the whole of the lower face 11, is regulated to be a surface roughness equal to or more than 12S in JIS (Japanese Industrial Standard) indication. And, as shown in FIG. 5 and FIG. 6B, surface roughness of a bottom face of the cavity portion 13 of the lower mold 3 and a molten metal guiding portion 29 adjacent to the portion 14 for fusing metal material (a biased area shown in FIG. 20), or of the whole of the concave portion, is regulated to be a surface roughness equal to or more than 12S in JIS (Japanese Industrial Standard) indication. Surface roughness 12S in JIS indication is equivalent to a roughness of which maximum height is more than 6 $\mu$m and equal to or less than 12 $\mu$m defined in B0601 of JIS, and, the surface roughness more than 12S in JIS indication is, namely, equivalent to a roughness of which maximum height is more than 6 $\mu$m defined in B0601 of JIS.

Figure 7:
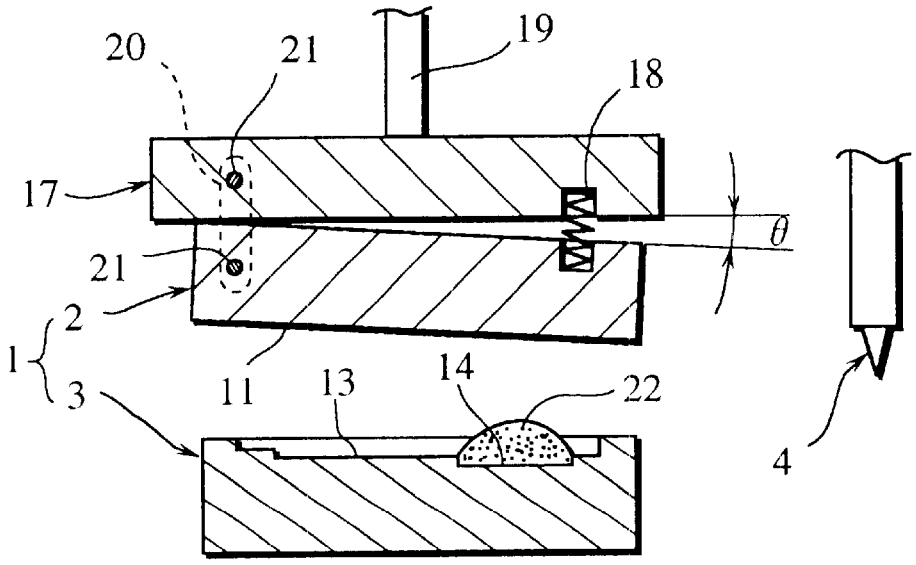
FIG. 7 is a cross-sectional front view showing a pre-molding state.
Figure 19:
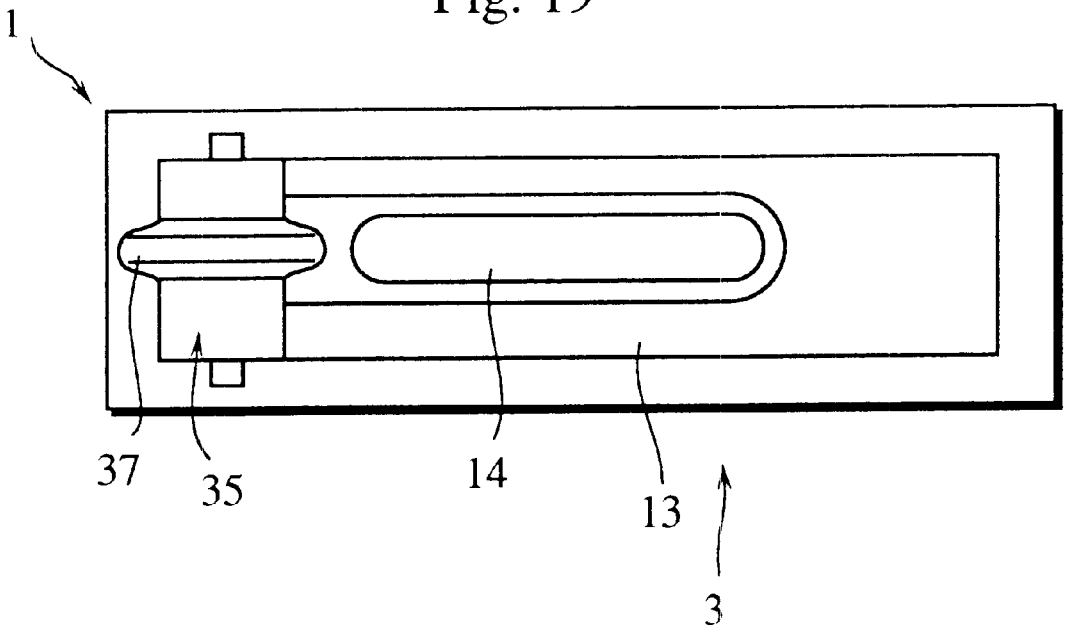
FIG. 19 is a plane view showing a seventh embodiment of the present invention.

As shown in FIG. 1 and FIGS. 7, 19 is an elevation rod of the upper mold moving mechanism 10, and an attachment member 17 for holding the upper mold 2 is horizontally attached to a lower end of the elevation rod 19. And, the upper mold 2 is attached to a lower face side of the attachment member 17 to be inclined. Concretely, one end side of the upper mold 2 and one end side of the attachment member 17 are connected through an elastic member 18 (a coil spring, for example), the other end side of the upper mold 2 and the other end side of the attachment member 17 are connected through two oscillating pieces 20 (only one of them is shown in Figures) and supporting shafts 21, and the upper mold 2 is inclined for a relatively small inclination angle θ by the elastic member 18 elastically pushing the one side of the upper mold 2 below. And, the lower mold 3 is horizontal same as the attachment member 17.

Therefore, the molded product of amorphous alloy of the present invention can be made with the manufacturing apparatus F provided with the above-described metal mold 1. That is to say, first, a metal material 22 is placed on the portion 14 for fusing metal material as shown in FIG. 1 and FIG. 7.

Figure 8:
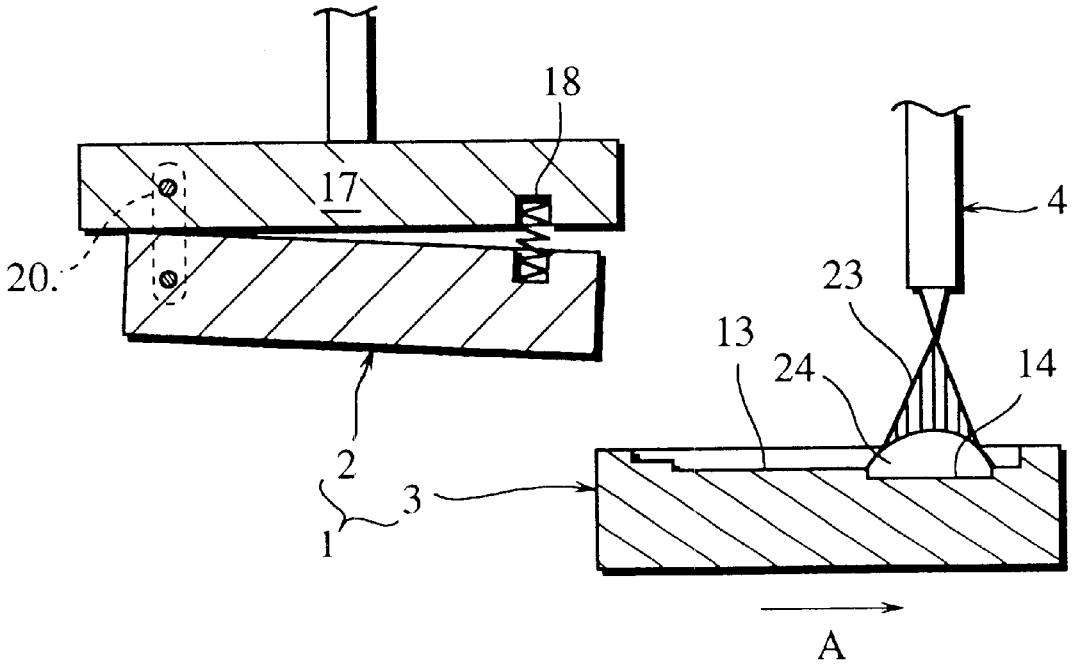
FIG. 8 is a cross-sectional front view showing a forming state of molten metal.

Next, as shown in FIGS. 1, 7, and 8, the lower mold 3 is moved in horizontal direction (a direction shown with an arrow A) by the lower mold moving mechanism 8 driven by the motor 7, and stopped at a position below the arc electrode 4. And, the arc power source is switched on, and plasma arc 23 is generated from an end of the arc electrode 4 to the metal material 22, and a molten metal 24 is obtained by fusing the metal material 22 completely. The molten metal 24 is stopped by the portion 14 for fusing metal material.

Figure 9:
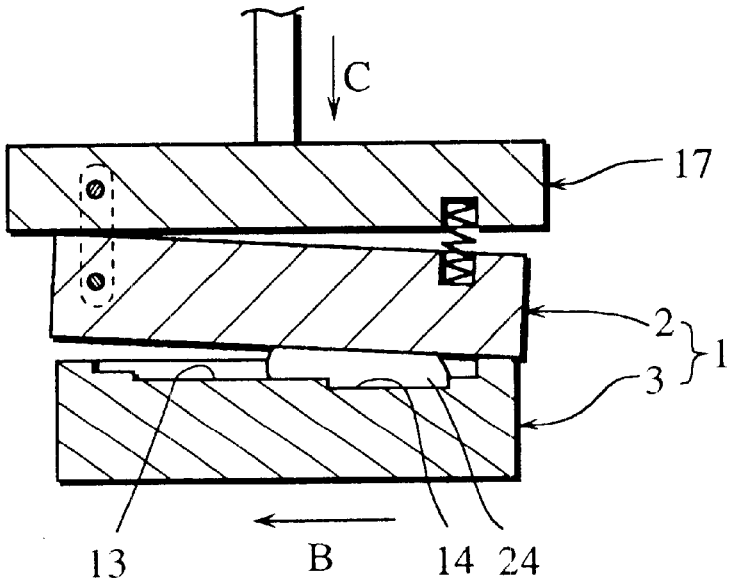
FIG. 9 is a cross-sectional front view showing a molding state.

Then, as shown in FIGS. 1, 8, and 9, the arc power source is switched off and the plasma arc 23 is put off. And, the lower mold 3 is swiftly moved (in a direction shown with an arrow B) to a position below the upper mold 2, the upper mold 2 is descended (in a direction shown with an arrow C) by the motor 9 and the upper mold moving mechanism 10, and the obtained molten metal 24 over a melting point is pressed and transformed into a predetermined configuration by co-working of the upper mold 2 and the lower mold 3. The molten metal 24 is cooled at over a critical cooling rate by the cooled metal mold 1 simultaneously with or after the transformation, and the molten metal 24 rapidly solidifies and becomes a molded product of amorphous alloy in the predetermined configuration.

Figure 10:
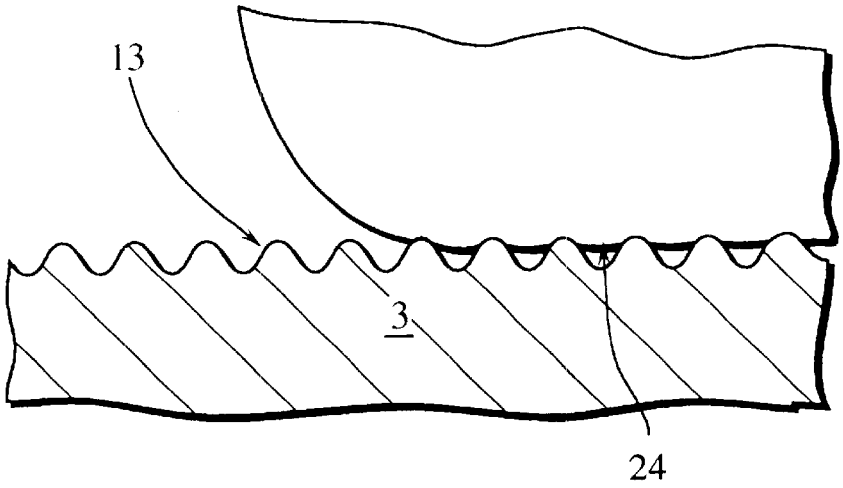
FIG. 10 is an enlarged cross-sectional view showing a contact state of the molten metal and a lower mold.

In this case, as shown in FIG. 9 and FIG. 10, when the inclined upper mold 2 gradually becomes horizontal and presses the molten metal 24, (as shown in FIG. 9) the molten metal 24 flows into the cavity portion 13 from the portion 14 for fusing metal material. The molten metal 24 tends to be smooth and having a small surface area for surface tension, and contacts the surface of the cavity portion 13 at many points. For this, cooling of the molten metal 24 is controled, and the molten metal 24 easily flows into the whole of the cavity portion 13.

Figure 11:
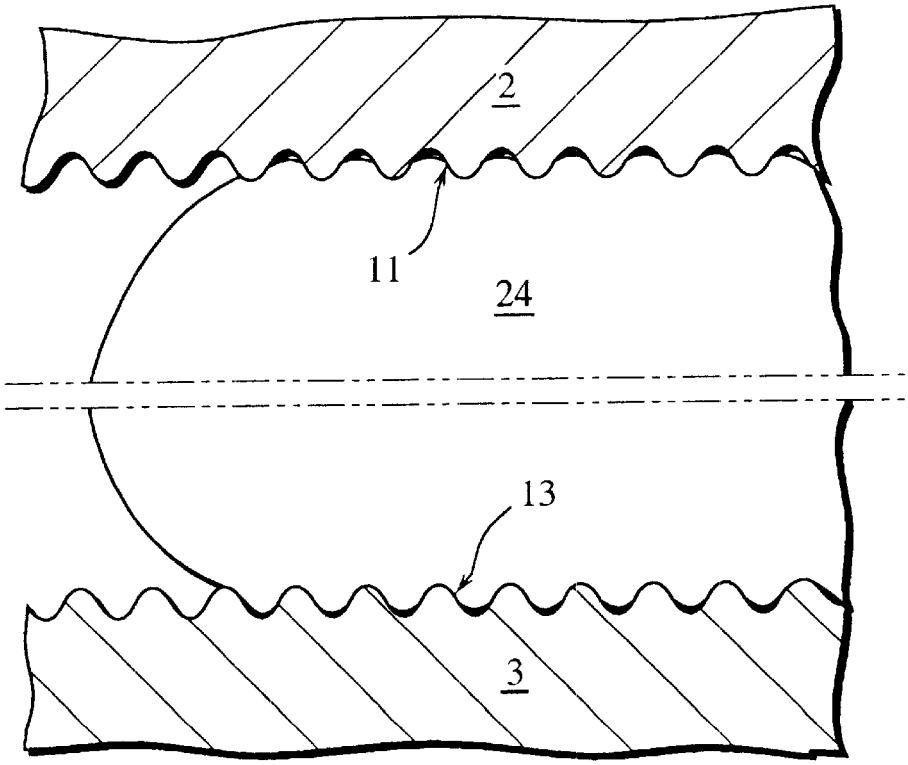
FIG. 11 is an enlarged cross-sectional view showing a contact state of the molten metal and the closed metal mold.
Figure 12:
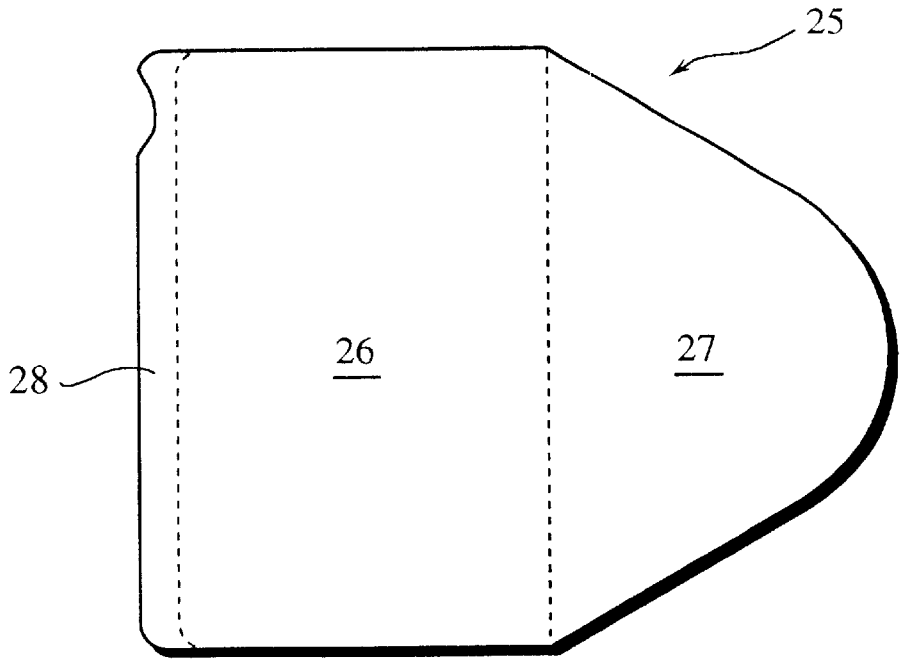
FIG. 12 is a plane view showing a molded product consists of amorphous alloy.

And, as shown in FIG. 11, the upper mold 2 is closed, that is to say, pressing force of the metal mold 1 to the molten metal 24 increases, the cavity portion 13 is filled with the molten metal 24, high cooling rate is obtained as contact area of the molten metal 24 and the metal mold 1 rapidly increases, and a molded product of amorphous alloy 25 of thin and large plate (the predetermined configuration) as shown in FIG. 12 is formed.

In many cases, the molded product of amorphous metal 25, molded with the metal mold 1 of which inner face is treated to have a surface roughness equal to or more than 12S (in JIS indication), has a surface roughness equal to or more than 12S. Especially, (as shown in FIG. 13B,) the molded product 25 having a surface roughness of 12S to 100S (preferably 25S to 70S) has high strength, and is formed into a predetermined configuration for good flowing of the molten metal. However, as the surface roughness becomes smaller than 12S or larger than 100S, strength reduction and flowing defection tend to be generated. The surface roughness 70S in JIS indication is equivalent to a roughness of which maximum height is more than 50 $\mu$m and equal to or less than 70 $\mu$m defined in B0601 of JIS, and, the surface roughness 100S in JIS indication is equivalent to a roughness of which maximum height is more than 70 $\mu$m and equal to or less than 100 $\mu$m defined in B0601 of JIS.

Figure 13A:
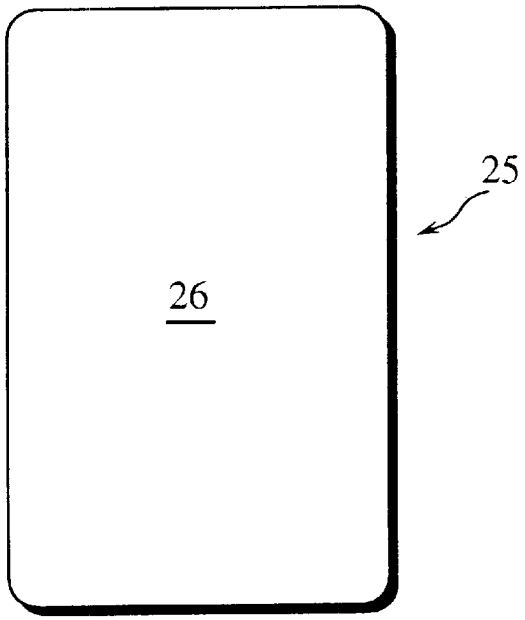
FIG. 13A is an explanatory view showing a product made of the molded product.
Figure 13B:
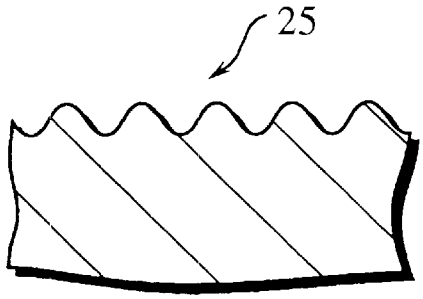
FIG. 13B is an explanatory view showing a surface of the product made of the molded product.

And, as shown in FIG. 5 and FIG. 12, in the above molded product of amorphous alloy 25 taken out of the metal mold, 26 is a part corresponding to the cavity portion 13 of the lower mold 3, 27 is a part corresponding to the portion 14 for fusing metal material and its adjacent parts, 28 is a part corresponding to the aperture forming portion 16 (a flash), and the molded product 25 is finished as a product shown in FIG. 13A by removing the unnecessary parts 21 and 28 with working such as cutting and polishing. In this case, surface of the part 26 corresponding to the cavity portion 13 has sufficient roughness (same as the metal mold) as shown in FIG. 13B.

To obtain the molded product of amorphous alloy 25 of thin plate spreading relatively uniformly, of which surface roughness is 12S to 100S (preferably 25S to 70S), it is necessary to smoothly fill the cavity portion 13 of the lower mold 3 with the molten metal in molding. For this condition, it is effective for flowing of the molten metal to make the surface roughness of the inner face of the metal mold 1, touching the molten metal, rougher than 12S in JIS indication (equivalent to a roughness of which maximum height is more than 6 $\mu$m and equal to or less than 12 $\mu$m defined in B0601 of JIS). Preferably, the roughness is equal to or more than 25S in JIS indication (equivalent to a roughness of which maximum height is more than 18 $\mu$m and equal to or less than 25 $\mu$m defined in B0601 of JIS). And, if the roughness is less than 12S in JIS indication, the contact area of the metal mold 1 and the molten metal increases, heat is taken from the molten metal thereby, and liquidity of the molten metal, for being filled into the cavity portion 13, is reduced.

And, in case that ununiformly extended configuration of molded product is obtained, and flowing of the molten metal is regulated by a runner portion (passageway for guiding the molten metal) in front of the cavity portion 13, namely, the molten metal guiding portion 29, to prevent cold shuts, it is effective for flowing of the molten metal to make the surface roughness partially (on parts of long flowing distance, the runner part, etc.) equal to or rougher than 12S in JIS indication (preferably, equal to or more than 25S).

And, it is preferable to regulate the surface roughness of the metal mold 1 with sand blast, grit blast, liquid honing, shot peening, etching, etc., since the flowing of the molten metal becomes uniform for uniform point contact of the metal mold 1 and the molten metal without directionality. And, it is preferable to treat a part of or the whole inner face of the metal mold with mold release agent or lubricant. Concretely, BN (boron nitride) is sprayed on the surface of the metal mold as a mold release agent, and heat treatment is conducted to remove impurity (organic solvent) included in the mold release agent. Although there are grease, silica, graphite, etc. as the mold release agent, the above mentioned BN is preferable because the molten metal is fused by high temperature, and the lower responsiveness to the metal material, the more preferable for the mold release agent. Further, the metal mold 1, of which surface roughness is regulated with sand blast, etc., can be smeared with mold release agent or lubricant.

On the other hand, the effect of the surface roughness (good flowing and rapid cooling of the molten metal) is remarkably obtained when the molten metal 1 is made of a material having a heat conductivity equal to or over $1\times10^2$ kcal/m·h·°C such as copper, copper alloy, silver, etc., because rapid cooling is necessary to make amorphous alloy. If the heat conductivity of the metal mold 1 is less than $1\times10^2$ kcal/m·h·°C., cooling rate of the molten metal decreases, and large molded product of amorphous alloy is not obtained for generation of crystalline layer.

Figure 14:
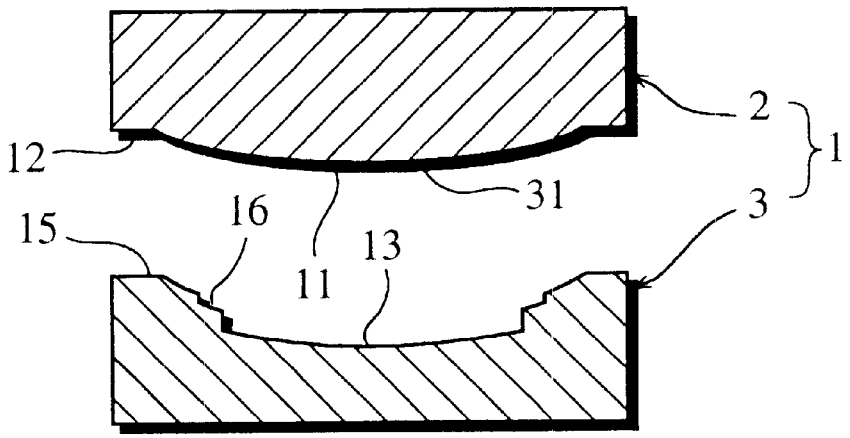
FIG. 14 is a cross-sectional front view showing a second embodiment of the present invention.

Next, FIG. 14 shows a second embodiment of the metal mold for manufacturing amorphous alloy of the present invention. In this metal mold 1, a lower face 11 of an upper mold 2 is a smooth face having a flat parting face 12 and a convex curved face 31. And, a lower mold 3 has a cavity portion 13 of concave curved face and a parting face 15 fitting to the parting face 12 of the upper mold 2 and a part of the convex curved face 31. And, an aperture forming portion 16 is formed on a part along the parting face 15 of the lower mold 3.

Figure 15:
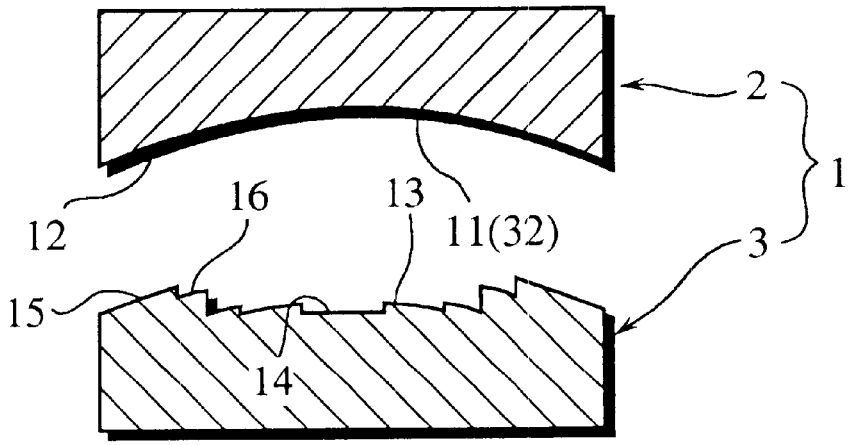
FIG. 15 is a cross-sectional front view showing a third embodiment of the present invention.

And, FIG. 15 shows a third embodiment. In this metal mold 1, a lower face 11 of an upper mold 2 is a smooth concave curved face 32, and a part of the smooth concave curved face 32 is a parting face 12. And, a lower mold 3 has a cavity portion 13 of convex curved face and a parting face 15 of convex curved face. Further, a portion 14 for fusing metal material which stops molten metal is formed on a center of a bottom face of the cavity portion 13.

Therefore, also in the metal mold 1 shown in FIG. 14 and FIG. 15, (same as the first embodiment) a part of or whole inner face which contacts the molten metal is treated to have a surface roughness equal to or more than 12S in JIS indication (preferably, equal to or more than 25S), and the metal mold is composed of a material having heat conductivity equal to or over $1\times10^2$ kcal/m·h·°C.

Figure 16A:
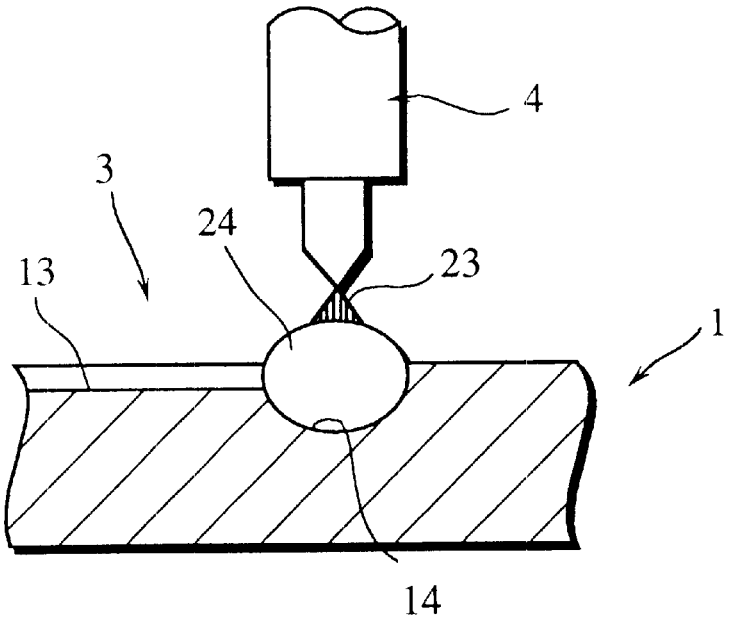
FIG. 16A is a working-explanatory view showing a fourth embodiment of the present invention.
Figure 16B:
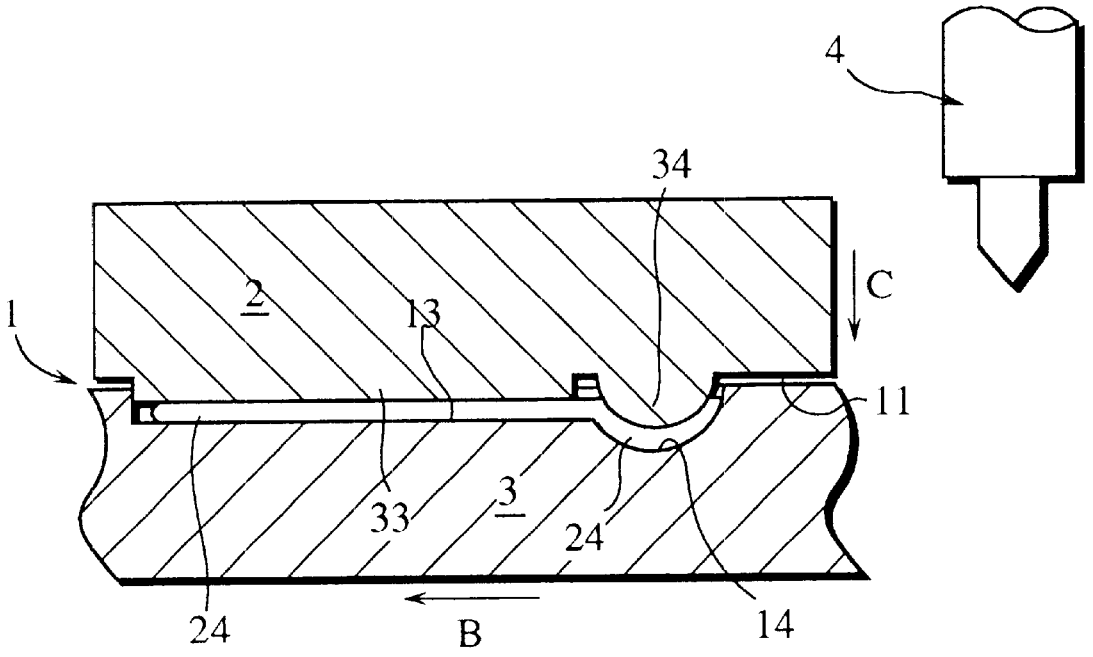
FIG. 16B is a working-explanatory view showing the fourth embodiment of the present invention.

FIG. 16A and FIG. 16B show a fourth embodiment of the metal mold for manufacturing amorphous alloy of the present invention. As shown in FIG. 16B, a rectangular flatboard convex 33 of small thickness dimension is formed on a lower face 11 of an upper mold 2 of a metal mold 1, and a molten metal displacement convex portion 34 is formed adjacent to the convex portion 33. And, as shown in FIG. 16A and FIG. 16B, a lower mold 3 has a cavity portion 13 fitting to the rectangular flatboard convex 33, and a portion 14 for fusing metal material of concave curved face, corresponding to the displacement convex portion 34 of the upper mold 2, is formed on the lower mold 3.

And, a part of or whole of the rectangular flatboard convex 33 and a part of or whole of the bottom face of the cavity portion 13 of the lower mold 3 are treated to have a surface roughness equal to or more than 12S in JIS indication (preferably, equal to or more than 25S), and the metal mold 1 is composed of a material having heat conductivity equal to or over $1\times10^2$ kcal/m·h·°C.

Then, in production of molded product of amorphous alloy with this metal mold 1, as shown in FIG. 16A, molten metal 24 is obtained by fusing a metal material placed on the portion 14 for fusing metal material, the lower mold 3 is moved to a position below the upper mold 2 and the upper mold 2 is descended as shown in FIG. 16A and FIG. 16B, the displacement convex portion 34 of the upper mold 2 presses from above the molten metal 24 raising on the portion 14 for surface tension. Then, the molten metal 24 flows from the portion 14 into the cavity portion 13, the rectangular flatboard convex portion 33 fits to the cavity portion 13 and extends the molten metal 24 to the whole surface of the cavity portion 13, the molten metal 24 is rapidly cooled, and a thin rectangular flat molded product of amorphous alloy is formed.

Figure 17A:
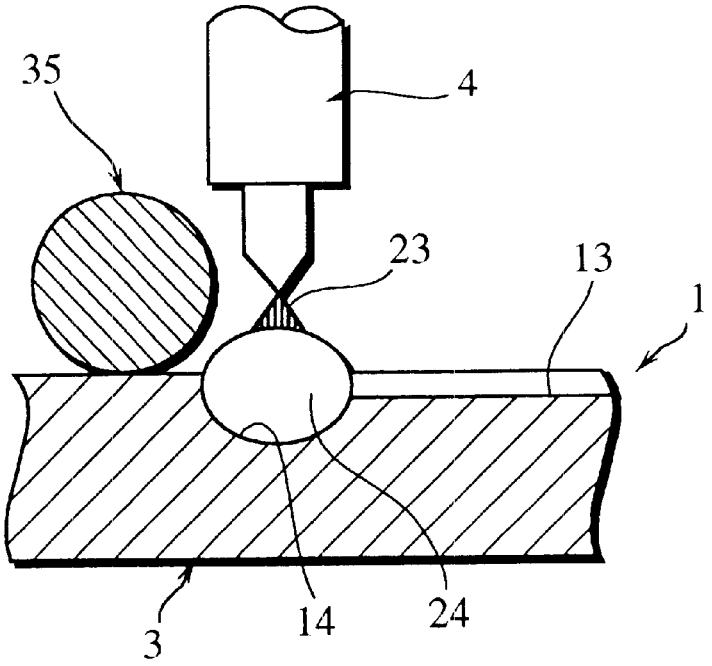
FIG. 17A is a working-explanatory view showing a fifth embodiment of the present invention.
Figure 17B:
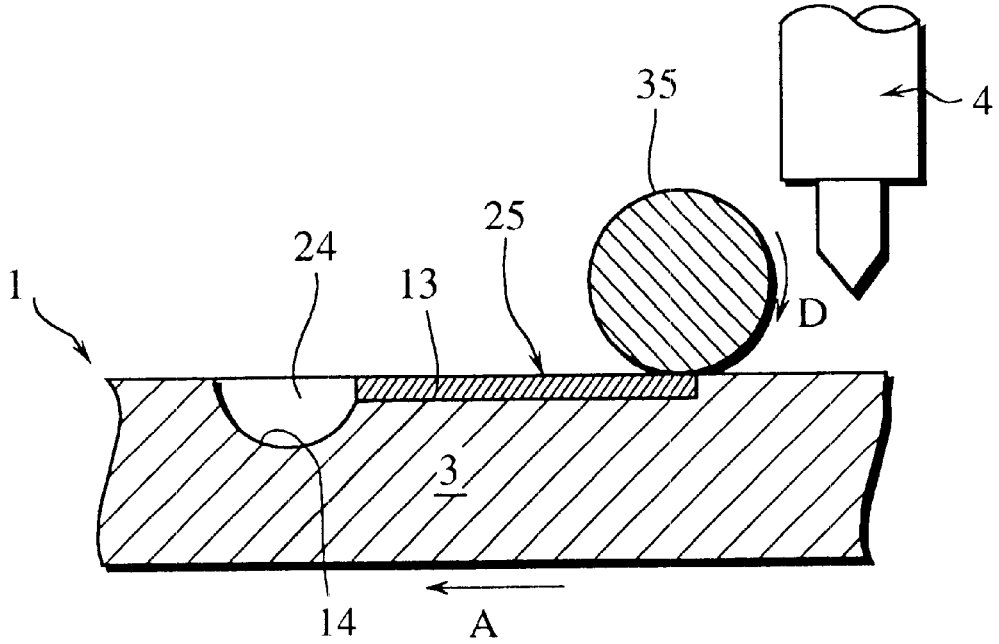
FIG. 17B is a working-explanatory view showing the fifth embodiment of the present invention.

FIG. 17A and FIG. 17B show a fifth embodiment. This metal mold 1 consists of a lower mold 3 having a portion 14 for fusing metal material of convex curved face, in which molten metal 24 on the portion 14 is poured into the cavity portion 13 by a roller 35. And, they are constructed as the lower mold 3 is moved in horizontal direction (a direction shown with an arrow A) by a lower mold moving mechanism (refer to FIG. 1), and the roller 35 is cooled and rotated (in a direction shown with an arrow D) by a motor (not shown in Figures) at a constant rate synchronized with the horizontal move of the lower mold 3. And, a part of or the whole bottom face of the lower mold 3 is treated to have a roughness equal to or more than 12S in JIS indication (preferably, equal to or more than 25S), and the metal mold 1 is made of a material having heat conductivity equal to or over $1\times10^2$ kcal/m·h·°C.

Then, in production of molded product of amorphous alloy with this metal mold 1, as shown in FIG. 17A, molten metal 24 is obtained by fusing a metal material placed on the portion 14 for fusing metal material, the cavity portion 13 of the lower mold 3 is moved to the roller 35 side (in a direction shown with an arrow A) as shown in FIG. 17A and FIG. 17B and the roller 35 is rotated, the molten metal 24 raising on the portion 14 for surface tension is poured into the cavity portion 13 and rolled by the roller 35, and the molten metal 24 is rapidly cooled. For this, a thin rectangular flat molded product of amorphous alloy is formed.

Figure 18:
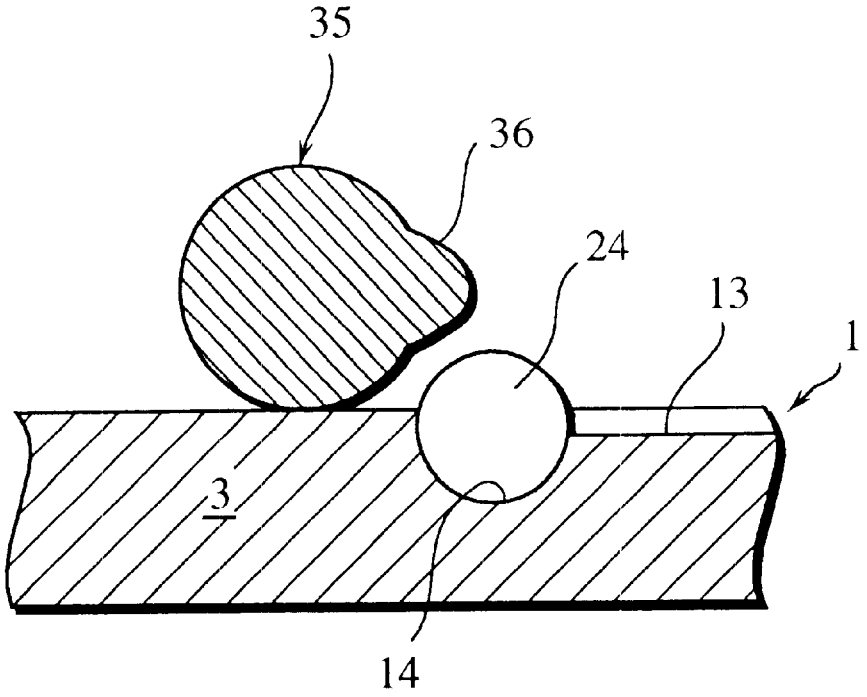
FIG. 18 is a cross-sectional side view showing a sixth embodiment of the present invention.

FIG. 18 shows a sixth embodiment, in which a protruding portion 36 for displacement of the metal mold is formed on a part, namely, on a part corresponding to the portion 14 for fusing metal material of the roller 35 described with reference to FIG. 17A and FIG. 17B. That is to say, the protruding portion 36 gets into a deeper portion of the portion 14 with the rotation of the roller 35, the molten metal 24 is not left in the portion 14 so much, and the amorphous metal is efficiently formed. And, it is preferable to form the protruding portion 36 of a material having low heat conductivity (carbon, for example) which hardly cools the molten metal 24.

And, FIG. 19 shows a seventh embodiment. In this lower mold 3, a portion 14 for fusing metal material is bar-shaped (a long semicylindrical) concave, and a cavity portion 13 is formed around the portion 14. They are constructed as metal material in the portion 14 is successively fused by an arc electrode 4 (refer to FIG. 1), the fused molten metal is successively poured into the cavity portion 13, rolled by the roller 35, and rapidly cooled. In this case, a protruding rim 37 of a predetermined length is formed of a material having low heat conductivity on a part of a peripheral face of the roller 35 corresponding to the portion 14.

Also in case of the metal mold 1 (the lower mold 3) described with reference to FIG. 18 and FIG. 19, a part of or the whole bottom face of the lower mold 3 is treated to have a roughness equal to or more than 12S in JIS indication (preferably, equal to or more than 25S), and the metal mold 1 is made of a material having heat conductivity equal to or over $1\times10^2$ kcal/m·h·°C. Further, in the lower mold 3 of FIG. 19, an inner face of the portion 14 for fusing metal material may be surface-treated to have surface roughness. And, it is also preferable to conduct a surface-treatment on the roller 35 and form the roller 35 of a material having heat conductivity equal to or over $1\times10^2$ kcal/m·h·°C to rapidly cool the molten metal 24 maintaining liquidity of the molten metal 24.

The present invention is not restricted to the embodiments described above. For example, the metal mold 1 may be a casting-type mold in which the molten metal is casted and formed into a predetermined configuration.

Figure 20:
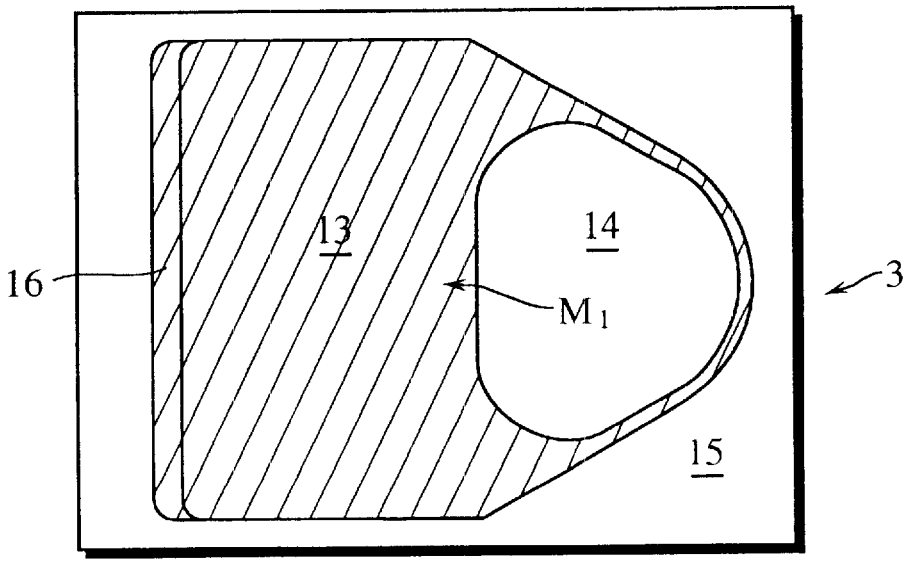
FIG. 20 is a plane view showing a grit-blasted area of the lower mold.
Figure 21:
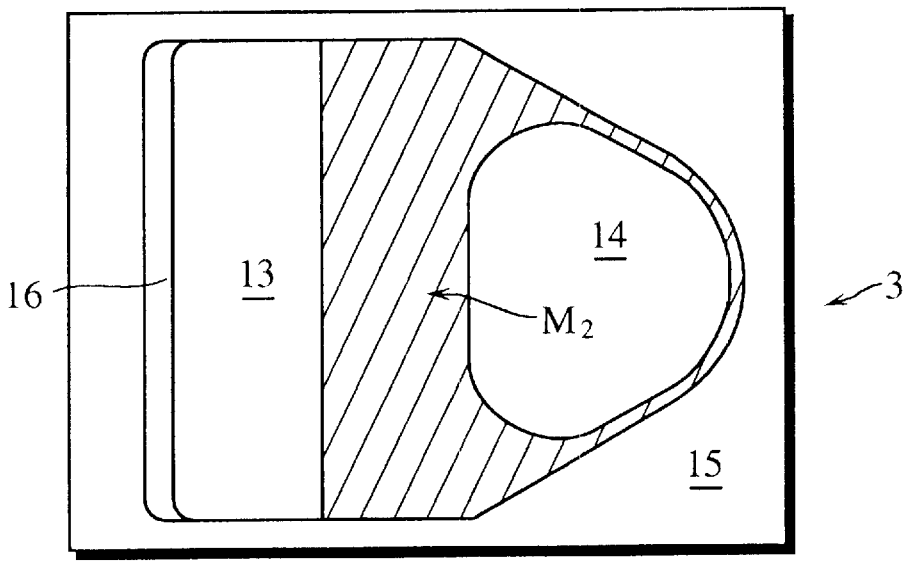
FIG. 21 is a plane view showing another grit-blasted area of the lower mold.

Next, concrete examples A through G of the present invention and a comparison example H are shown in FIG. 20, FIG. 21, and Table 1. The metal mold of the examples A through G and the comparison example H is equivalent to the metal mold 1 described with reference to FIG. 2 through FIG. 5, and as dimension of the cavity portion 13 of the lower mold 3, length dimension X is 80 mm, and width dimension Y is 50 mm. And, an area surrounded by an imaginary line in FIG. 3 shows a grit blasted area M, and biased portions of FIG. 20 and FIG. 21 show grit blasted areas $M_1$ and $M_2$ respectively.

TABLE 1

| | | GRIT-BLASTED AREA | SURFACE ROUGHNESS | DEGREE OF FILLING (FLOWING) | DEGREE OF AMORPHOUS |
|---|---|---|---|---|---|
| EXAMPLE A | U | M | 12S | 95% | ○ |
| | L | $M_1$ | 12S | | |
| EXAMPLE B | U | M | 25S | 100% | ○ |
| | L | $M_1$ | 25S | | |
| EXAMPLE C | U | M | 50S | 100% | ○ |
| | L | $M_1$ | 50S | | |
| EXAMPLE D | U | M | 100S | 95% | ○ |
| | L | $M_1$ | 100S | | |
| EXAMPLE E | U | — | 1.5S | 90% | ○ |
| | L | $M_1$ | 25S | | |
| EXAMPLE F | U | M | 25S | 90% | ○ |
| | L | — | 1.5S | | |
| EXAMPLE G | U | — | 1.5S | 80% | ○ |
| | L | $M_2$ | 25S | | |
| COMPARISON EXAMPLE H | U | — | 1.5S | 60% | ○ |
| | L | — | 1.5S | | |

U-upper mold
L-lower mold

And, concrete examples 1 through 3 are shown in FIG. 20, FIG. 21, and Table 2. The metal mold of the examples 1 through 3 is equivalent to the metal mold 1 described with reference to FIG. 2 through FIG. 5, and as dimension of the cavity portion 13 of the lower mold 3, length dimension X is 80 mm, and width dimension Y is 50 mm. And, an area surrounded by an imaginary line in FIG. 3 shows a grit-blasted/ or BN (boron nitride)-sprayed area M, and biased portions of FIG. 20 and FIG. 21 show grit-blasted/ or BN-sprayed areas M, and $M_2$ respectively.

TABLE 2

| | | BN-SPRAYED AREA | GRIT-BLASTED AREA | SURFACE ROUGHNESS | DEGREE OF FILLING (FLOWING) | DEGREE OF AMORPHOUS |
|---|---|---|---|---|---|---|
| EXAMPLE 1 | U | M | — | 1.5S | 100% | Δ |
| | L | $M_1$ | — | 1.5S | | |
| EXAMPLE 2 | U | — | — | 1.5S | 95% | Δ |
| | L | $M_1$ | — | 1.5S | | |
| EXAMPLE 3 | U | M | M | 25S | 100% | Δ |
| | L | $M_1$ | $M_1$ | 25S | | |
| EXAMPLE B | U | — | M | 25S | 100% | ○ |
| | L | — | $M_1$ | 25S | | |
| COMPARISON EXAMPLE H | U | — | — | 1.5S | 60% | ○ |
| | L | — | — | 1.5S | | |

U-upper mold
L-lower mold
Example B and comparison example H are taken from Table 1 for reference
Δ in the column of degree of amorphous means a case that crystalline grits are observed inside a mostly amorphous product.

The above-mentioned areas M, $M_1$, and $M_2$ are regulated to have various surface roughnesses as shown in Table 1 and Table 2, by grit blast to the metal mold of which fundamental surface roughness is 1.5S.

And, in the examples A through D, the area $M_1$ of the lower mold 3 (refer to FIG. 20), and the area M of the upper mold 2 (refer to FIG. 3) are grit-blasted. And, only the area $M_1$ of the lower mold 3 is grit-blasted in the example E, only the area M of the upper mold 2 is grit-blasted in the example F, only the area $M_2$ (refer to FIG. 21) is grit-blasted in the example G, and both of the upper mold 2 and the lower mold 3 are not grit-blasted in the comparison example H.

And, in the example 1, both of the upper mold 2 and the lower mold 3 are not grit-blasted, and the area M of the upper mold 2 and the area $M_1$ of the lower mold 3 are sprayed with BN. In the example 2, both of the upper mold 2 and the lower mold 3 are not grit-blasted, and only the area $M_1$ of the lower mold 3 is sprayed with BN. And, in the example 3, both of the upper mold 2 and the lower mold 3 are grit-blasted, and the area M of the upper mold 2 and the area $M_1$ of the lower mold 3 are sprayed with BN.

And, in the grit blast, for example, in the example B of which surface roughness is 25S, steal grits of which particle size is # 50 are blown to the metal mold with a pressurized blast machine.

Next, amorphous alloy forming experiment was conducted on the examples A through G and the comparison example H, and on the examples 1 through 3 under the conditions below.

① The manufacturing apparatus F, described with reference to FIG. 1, is used.

② Oxygen free copper is used for the metal mold material.

③ An alloy of $Zr_{55}Al_{10}Ni_5Cu_{30}$ is used for the material of amorphous alloy.

④ The inclination angle θ of the upper mold 2 is 1° in pre-molding state.

Figure 22:
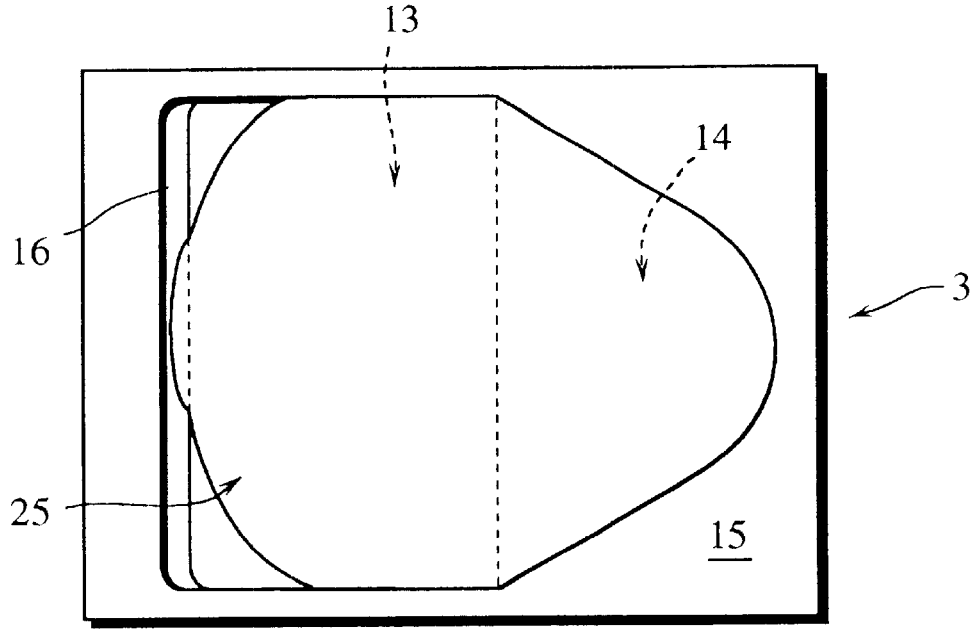
FIG. 22 is a plane view showing a degree of filling of the molten metal in a cavity portion of the metal mold.
Figure 23:
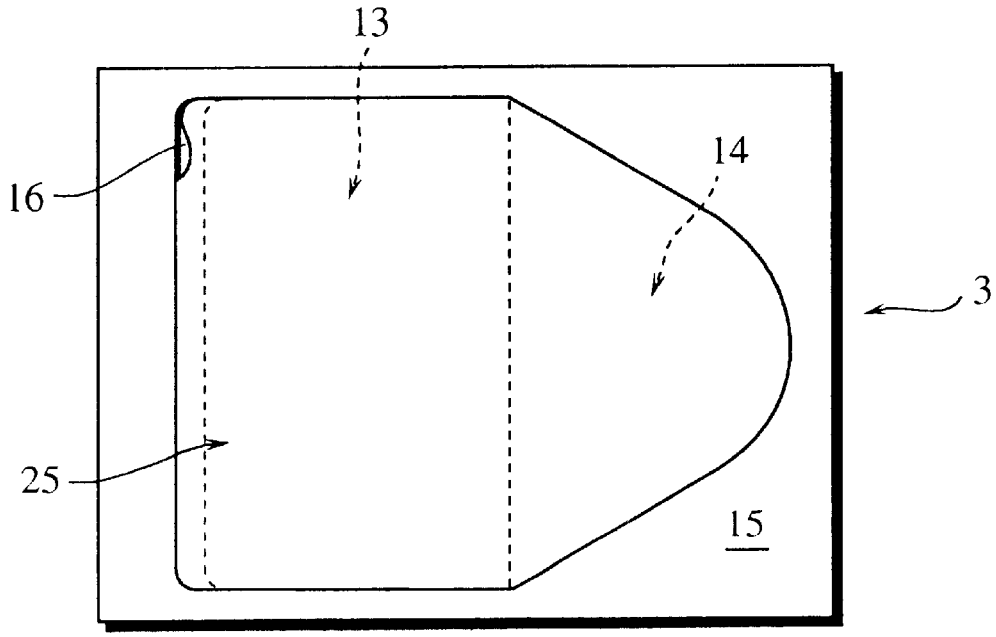
FIG. 23 is a plane view showing a degree of filling of the molten metal in a cavity portion of another metal mold.
Figure 24:
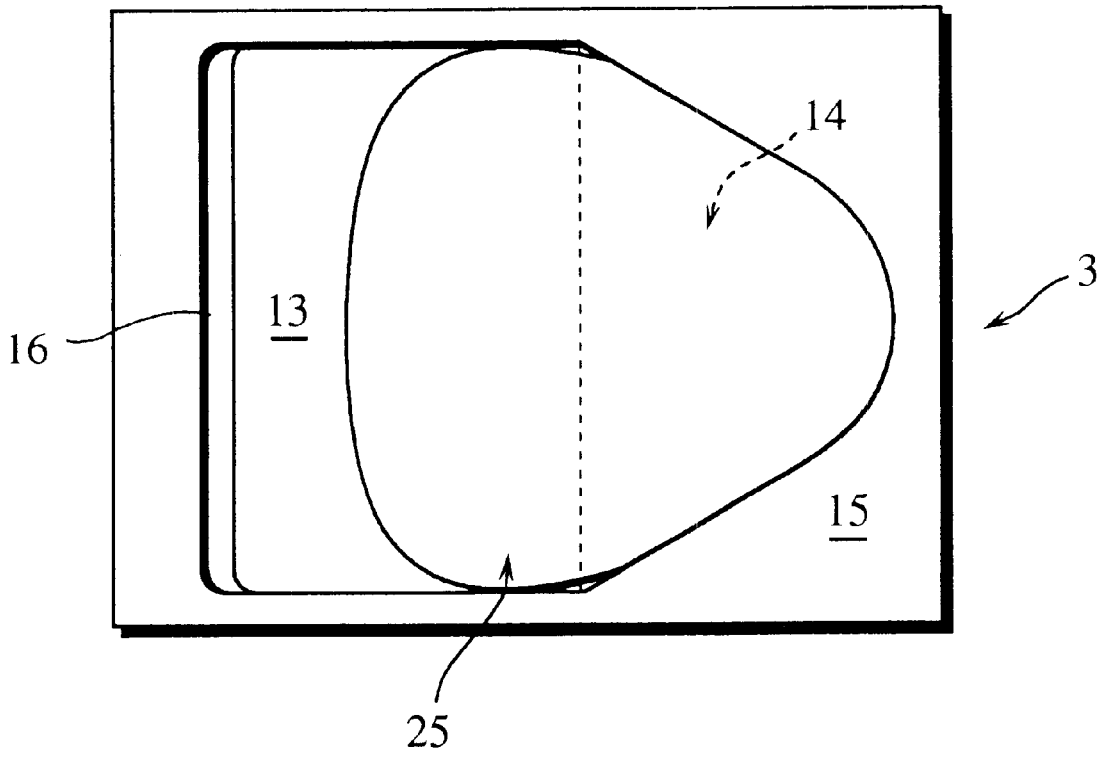
FIG. 24 is a plane view showing a degree of filling of the molten metal in a cavity portion of a still another metal mold.

The result of the forming experiment is shown in Table 1 and Table 2, FIG. 22, FIG. 23, and FIG. 24. Degree of filling (flowing of the molten metal) is evaluated by degree of filling (area percentage) of the cavity portion 13. Measuring method of the area percentage is that configuration of molded product is traced on plotting paper, and the area percentage is determined by counting the number of ruled squares. And, it is checked with X-ray analysis and observation through an optical microscope that a part of the molded product corresponding to the cavity portion 13 is normally made amorphous or not. FIG. 22 shows results of the examples A and D, and the examples 1 and 2, FIG. 23 shows results of the examples B and C, and the examples 1 and 3, and FIG. 24 shows result of the comparison example H.

First, followings are shown by Table 1, FIG. 22, FIG. 23, and FIG. 24. That is to say, in the examples A and D, although degree of filling is 95% and slightly insufficient because the molten metal does not sufficiently flow into the cavity portion 13, the molded product is amorphous. And, in the examples B and C, degree of filling is 100% because the molten metal sufficiently flows into the cavity portion 13, and the molded product is amorphous. And, in the examples E and F, although degree of filling is 90% and insufficient, the molded product is amorphous. It is shown that flowing effect is not sufficient when only the lower mold has a rough surface or only the upper mold has a rough surface. And, although degree of filling of the example G is further low of 80%, the molded product is amorphous. And, despite very low degree of filling of the comparison example H of 60%, the molded product is amorphous.

And, followings are shown by Table 2, FIG. 22, and FIG. 23. That is to say, in the examples 1 and 3, degree of filling is 100% because the molten metal sufficiently flows into the cavity portion 13 in molding, and the molded product is mostly amorphous. "Mostly amorphous" means that small crystalline grits are dispersed inside the amorphous phase, machine characteristics of the molded product such as strength are sufficiently high in comparison with that of a molded product of crystalline as a whole, and matching that of a molded product totally composed of amorphous phase. In the example 2, although degree of filling is 95% and slightly insufficient because the molten metal does not sufficiently flow into the cavity portion 13 in molding, the molded product is mostly amorphous. And, the example B and the comparison example H in Table 2 are taken from Table 1 for reference.

Based on these results, it is expected that grit blast on both of the upper mold and the lower mold, and surface roughness of 12S to 100S, are effective to make the flowing of the molten metal better. Especially, the surface roughness of 25S to 70S is preferable. And, it is also expected that spraying both of the upper mold and the lower mold with BN is effective to make the flowing of the molten metal better.

According to the metal mold for manufacturing amorphous alloy of the present invention, a thin plate amorphous alloy having large area (molded product of plate) because the molten metal 24 can sufficiently flow inside the metal mold, and the molten metal 24 is cooled by the metal mold at a high cooling rate as the molten metal is filled into the cavity portion 13.

And, the liquidity of the molten metal in the metal mold is further-improved, the point contact of the surface-treated inner face of the metal mold and the molten metal 24 becomes uniform and undirectional, and the flowing of the molten metal 24 in the metal mold becomes uniform.

Further, it is possible to obtain an amorphous alloy piece of larger area for the metal mold having high cooling rate and improving the liquidity of the molten metal, and a thin amorphous metal piece of large area can be easily and certainly made.

And, according to the metal mold for manufacturing amorphous alloy of the present invention, the molten metal flows smoothly for the roller 35. And, production of the metal mold 1 is easy.

And, the flowing of the casted molten metal is good, and the degree of filling is improved. Further important point is that cast-molded product of amorphous metal having good characteristics can be obtained for prevention of crystallization of amorphous part of the first-inflow molten metal, formerly solidified and became amorphous, by re-heating with later-inflow molten metal, because timings of solidification of the first-inflow molten metal and the last-inflow molten metal become proximate for the good flowing of the molten metal.

According to the molded product of amorphous alloy of the present invention, the molded product of amorphous alloy is thin, having a large area, excellent in strength characteristics, and widely used as a structural material, etc. And, the molded product of amorphous alloy has larger area for further-improved liquidity of the molten metal 24 in the metal mold.

While preferred embodiments of the present invention have been described in this specification, it is to be understood that the invention is illustrative and not restrictive, because various changes are possible within the spirit and indispensable features.

What is claimed is:

1. A method for manufacturing a molded product of amorphous alloy by using a metal mold having a mold body having an inner face, a surface roughness of at least a part of the inner face of the metal mold being equal to or more than 12S in JIS indication, a part of or the whole inner face of the metal touching a metal material is not surface-treated with mold release agent or lubricant, the metal mold including a lower mold having a portion for fusing metal material and a cavity portion, and an upper mold which works together with the lower mold to press the molten metal on the portion for fusing metal material and cause the metal material to flow in to the cavity portion, and thereby mold the metal material, comprising the steps of:

fusing a metal material with a high energy heat source capable of fusing the metal material to obtain a molten metal;

transforming obtained molten metal into a predetermined configuration;

cooling the molten metal at over a critical cooling rate simultaneously with or after the transformation for molding the molten metal into the predetermined configuration.

2. A method for manufacturing a molded product of amorphous alloy by using a metal mold having a mold body having an inner face, a surface roughness of at least a part of the inner face of the metal mold or the inner face before it is coated if the inner face is going to be coated being equal to or more than 12S in JIS indication, the metal mold including a lower mold having a portion for fusing metal material and a cavity portion, and an upper mold which works together with the lower mold to press the molten metal on the portion for fusing metal material and cause the metal material to flow in to the cavity portion, and thereby mold the metal material, comprising the steps of:

fusing a metal material in a portion for fusing material with a high energy heat source capable of fusing the metal material to obtain a molten metal;

transforming obtained molten metal into a predetermined configuration;

cooling the molten metal at over a critical cooling rate simultaneously with or after the transformation for molding the molten metal into the predetermined configuration.

* * * * *